US005868553A

United States Patent [19]

Bättig et al.

[11] Patent Number: 5,868,553

[45] Date of Patent: Feb. 9, 1999

[54] EXHAUST GAS TURBINE OF AN EXHAUST GAS TURBOCHARGER

[75] Inventors: Josef Bättig, Egliswil; Urs Vögtli, Dornach, both of Switzerland

[73] Assignee: Asea Brown Boveri AG, Baden, Switzerland

[21] Appl. No.: 839,644

[22] Filed: Apr. 15, 1997

[30] Foreign Application Priority Data

May 8, 1996 [DE] Germany ..... 196 18 314.6

[51] Int. Cl.[6] ..... F01D 9/04

[52] U.S. Cl. ..... 415/189; 415/138; 415/209.4; 415/214.1

[58] Field of Search ..... 415/136, 138, 415/189, 190, 209.2, 209.3, 209.4, 214.1

[56] References Cited

U.S. PATENT DOCUMENTS 5,207,565 5/1993 Roessler ..... 415/202
5,271,714 12/1993 Shepherd et al. ..... 415/209.2

FOREIGN PATENT DOCUMENTS 0103260 3/1984 European Pat. Off. ..... 415/136
0118051 9/1984 European Pat. Off. .
0191380 8/1986 European Pat. Off. .
928746 6/1955 Germany .
1036581 8/1958 Germany .
2947292C2 6/1982 Germany .
4223496A1 1/1994 Germany .

*Primary Examiner*—Thomas E. Denion
*Assistant Examiner*—Richard Woo
*Attorney, Agent, or Firm*—Burns, Doane, Swecker & Mathis, L.L.P.

[57] ABSTRACT

An exhaust gas turbine for an exhaust gas turbocharger has a nozzle ring having an inner ring and an outer ring supporting a plurality of guide vanes. The nozzle ring is diagonally supported between a covering ring and the inlet casing, with the outer ring bearing against the covering ring and the inner ring bearing against the inlet casing. The outer ring provides an axial expansion gap with gas inlet casing and a radial expansion gap with the gas outlet casing. The nozzle ring is free to expand into the axial and radial gaps as a result of thermal expansion, without causing stress to the adjacent components.

7 Claims, 2 Drawing Sheets

EXHAUST GAS TURBINE OF AN EXHAUST GAS TURBOCHARGER

BACKGROUND OF THE INVENTION

1. Field of the Invention

The invention relates to the exhaust gas turbine of an exhaust gas turbocharger which is connected to an internal combustion engine.

2. Discussion of Background

During operation of an exhaust gas turbocharger, the exhaust gas turbine of the latter is exposed to relatively high temperatures from the internal combustion engine connected thereto. High thermal stresses thus arise in the turbine-side components, such as for example the gas inlet casing, the nozzle ring, the covering ring and the gas outlet casing. Since each of these components is at a different distance from the internal combustion engine and, moreover, different materials are used, the component temperatures differ accordingly. This results in different thermal expansions with relative movements between the individual components, which may lead to screws breaking, gas leakages and components cracking. The design and arrangement of the separating locations of gas inlet casing, gas outlet casing, nozzle ring and covering ring thus play an important part in the ability of an exhaust gas turbocharger to function.

DE-A1-4223496 has disclosed a screw connection of the nozzle ring to the gas inlet casing. For this connection, the inner ring of the nozzle ring is of thickened design and provided with an additional flange which receives the screws serving for connection to the gas inlet casing.

The one-sided screw connection may lead to irreversible distortions of the nozzle ring in the event of such a solution. Moreover, there is the risk of a bypass flow being formed on the outer ring of the nozzle ring, as a result of which the efficiency of the exhaust gas turbine and thus that of the turbocharger is reduced. Owing to the high generation of heat on the turbine side, the screws serving to fasten the nozzle ring are positioned in a very fixed manner and can only be removed with very great difficulty. The assembly time required to exchange the nozzle ring is therefore considerably lengthened, which is a significant disadvantage for the internal combustion engine which is connected to the exhaust gas turbocharger and is dependent on the latter in terms of its power.

EP-B1-191380 shows the exhaust gas turbine of an exhaust gas turbocharger, the nozzle ring of which turbine is clamped against the gas inlet casing by the covering ring. For this purpose, the outer ring of the nozzle ring has an axial projection and the covering ring has a corresponding fastening flange. The latter is connected to the gas inlet casing by means of a plurality of screws. In the peripheral direction, the nozzle ring is fixed on the gas inlet casing by means of positively locking centering bolts.

A drawback which is common to both solutions is that the nozzle ring in each case has an additional component for arranging or accommodating fastening elements. As a result, its production is complicated and thus relatively expensive. Moreover, both the axial projection of the outer ring and the flange of the inner ring are at risk from cracking, owing to the thermal stresses which have already been described above, as a result of which reliable fastening of the nozzle ring and thus the functioning of the turbocharger are not ensured in the long term.

SUMMARY OF THE INVENTION

Accordingly, one object of the invention is to avoid all these drawbacks by designing the exhaust gas turbine of an exhaust gas turbocharger such that simple and reliable fastening of the nozzle ring is ensured.

This is achieved according to the invention in that, the nozzle ring bears against the covering ring by means of its outer ring and against the gas inlet casing by means of its inner ring. An axial expansion gap is formed between the outer ring and the gas inlet casing and a radial expansion gap is formed between the outer ring and the gas outlet casing.

The reasons for the advantages of the invention are that the nozzle ring is only braced diagonally between the gas outlet casing and the gas inlet casing. Owing to this fastening, the flux of force in the nozzle ring starts from the covering ring and passes via the outer ring, the guide vanes and the inner ring as far as the gas inlet casing. Due to the two expansion gaps, the nozzle ring can expand freely both in the radial and in the axial direction. This diagonal bracing of the nozzle ring provides the conditions for free thermal expansions between the turbine-side components, so that either no thermal stresses are formed or these stresses can be compensated.

There are no components which are at risk of cracking and reinforce the nozzle ring. It is thus of relatively resilient, i.e. elastic, design and to a certain extent acts as a diaphragm between the components surrounding it. Since the nozzle ring has no fastening flanges, it can be manufactured in a simple and cost-effective manner. Since as a result no screws are required for its fastening, working time is also saved during assembly and dismantling. As an additional advantage, the nozzle ring can now be mounted from both sides, i.e. both from the compressor side and from the side of the internal combustion engine.

It is particularly expedient if a sealing surface with respect to the gas inlet casing is arranged on the gas outlet casing. An assembly gap is formed radially outside the sealing surface between the gas outlet and the gas inlet casing. By virtue of this design, effective sealing is achieved between gas inlet and gas outlet casing.

Furthermore, it is advantageous if the gap width of the axial and/or of the radial expansion gap is designed to be larger than or equal to the maximum thermal expansion of outer ring and gas inlet casing and of outer ring and gas outlet casing, respectively.

In this manner it is ensured that the nozzle ring retains its elastic form, that is to say no stresses occur, under all operating conditions of the exhaust gas turbine. In an extreme case, the outer ring may bear lightly in the axial direction on the gas inlet casing and in the radial direction on the gas outlet casing, without the resultant pressure leading to wear of the material. This has the advantage that gas leakages can be prevented.

Finally, both the outer and also the inner ring each have a significantly smaller material thickness than the covering ring and the gas inlet casing. The resulting minimal differences in wall thickness between the guide vanes of the nozzle ring and its outer and inner ring have the consequence of only low thermal stresses.

It is particularly advantageous if outer and inner ring are made from sheet metal. The nozzle ring can thus be manufactured in a very simple and cost-effective manner.

In a second configuration of the invention, a clamping segment, which is positively locking with the gas inlet casing and also with the gas outlet casing in the axial direction, is arranged on the said gas inlet casing and is provided with recesses for the connecting elements. At least one radial gap is formed between the gas inlet casing and the clamping segment. In contrast to the first configuration, the thermal expansions of the gas inlet casing can also be compensated for in this manner. Consequently, the connection location of gas inlet and gas outlet casing is relieved of load, so that significantly lower operating stresses occur. For this reason, the solution is also particularly suitable for turbochargers which are subject to high thermal loads.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, which show two exemplary embodiments of the invention with reference to the axial turbine of an exhaust gas turbocharger and wherein.

Figure 1:
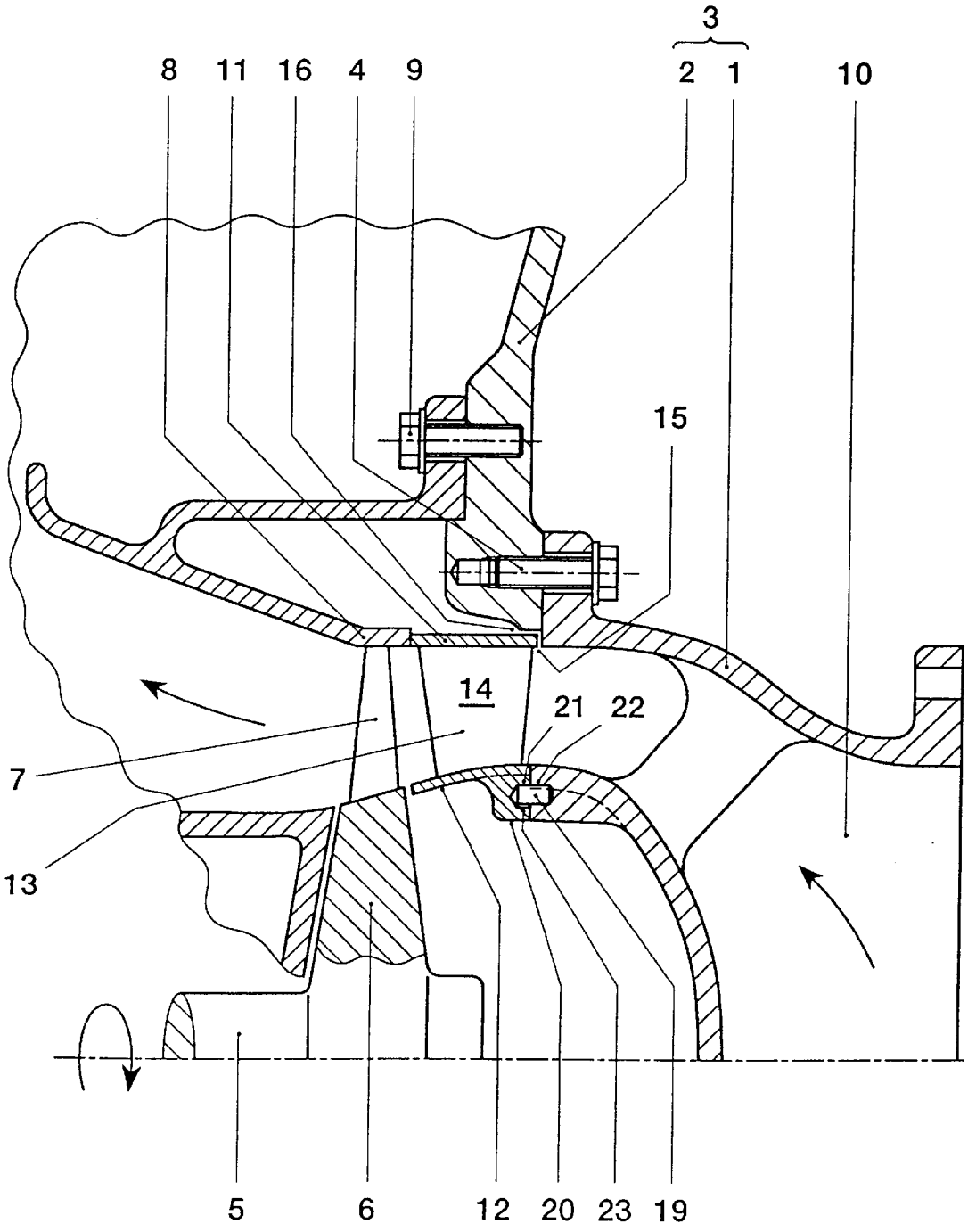
FIG. 1 shows a partial longitudinal section of the exhaust gas turbocharger in the region of the exhaust gas turbine.

Only the elements which are essential to the comprehension of the invention are shown. The internal combustion engine and the compressor side of the exhaust gas turbocharger, for example, are not shown. The direction of flow of the operating medium is indicated by arrows.

DESCRIPTION OF THE PREFERRED EMBODIMENTS

Referring now to the drawings, wherein like reference numerals designate identical or corresponding parts throughout the several views, the exhaust gas turbine of a turbocharger has a turbine casing 3, which is formed by a gas inlet and a gas outlet casing 1, 2 and is held together by means of connecting elements 4 designed as screws. A turbine rotor 6 supported by a shaft 5 and having rotor blades 7 is arranged in the turbine casing 3. The turbine rotor 6 is outwardly delimited by a covering ring 8 which is designed as a diffuser and is in turn fastened on the gas outlet casing 2 by screws 9. A flow duct 10 is formed between the turbine rotor 6 and the turbine housing 3, which flow duct receives the exhaust gases from a diesel engine, which is not shown and is connected to the turbocharger, and conducts them further to the turbine rotor 6. Of course, a different internal combustion engine may also be connected to the turbocharger.

A nozzle ring 14 comprises an outer ring 11, an inner ring 12 and a number of guide vanes 13 arranged between the outer ring and inner ring. The nozzle ring 14 is formed as a casting, and is arranged in the flow duct 10 upstream of the turbine rotor 6. The said nozzle ring is axially braced between the covering ring 8 and the gas inlet casing 1 and is arranged radially inside the gas outlet casing 2. To this end, the nozzle ring 14 bears against the covering ring 8 with its outer ring 11 and against the gas inlet casing 1 with its inner ring 12. Both its outer and the inner ring 11, 12 each have a significantly smaller material thickness than the covering ring 8 and the gas inlet casing 1 (FIG. 1). Naturally, the nozzle ring 14 may also be made from different materials, such as for example of sheet metal or steel profiles, or consist of ceramic.

An axial expansion gap 15 is formed between the outer ring 11 and the gas inlet casing 1 and a radial expansion gap 16 is formed between the outer ring 11 and the gas outlet casing 2. The gap width of the expansion gaps 15, 16 is larger than the maximum thermal expansion of outer ring 11 and gas inlet casing 1 and of outer ring 11 and gas outlet casing 2, respectively. The ratio of the gap width of the radial expansion gap 16 to the gap width of the axial expansion gap 15 is here about 4:1. This ratio is produced by the radial and the axial dimensions of the nozzle ring 14. Naturally, the gap widths may also correspond to the maximum thermal expansion of the components concerned.

Figure 2:
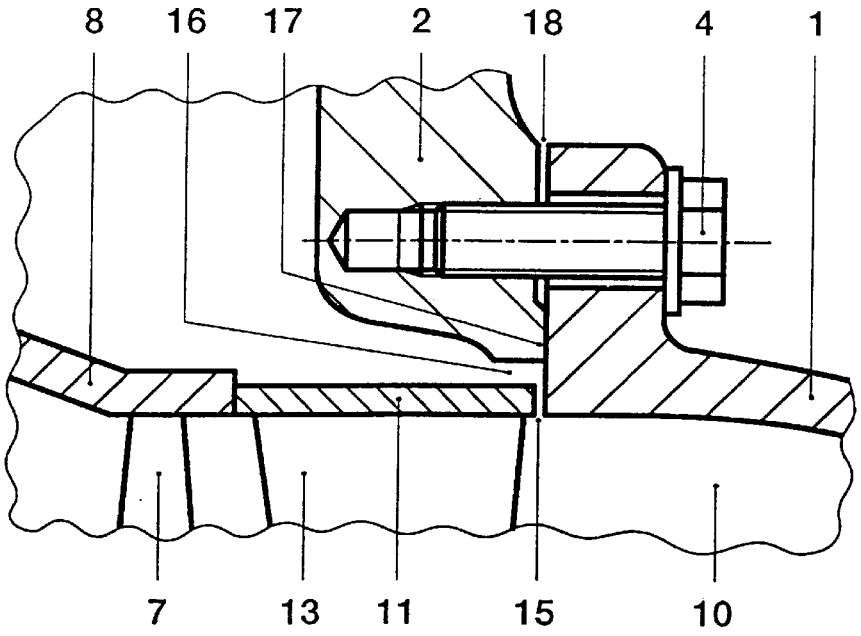
FIG. 2 shows an enlarged detail from FIG. 1, in the region of the outer ring.

FIG. 2 shows an enlarged detail of FIG. 1 which approximately illustrates the size ratios of the gap widths. A sealing surface 17 with respect to the gas inlet casing 1 is formed on the radially inner region of the gas outlet casing 2. An assembly gap 18 is arranged radially outside this sealing surface 17 between the gas outlet casing 2 and the gas inlet casing 1.

The inner ring 12 is supported on the gas inlet casing 1 in a manner secure against torsion by means of a plurality of positioning elements 19 designed as pins. To receive the pins 19, the inner ring 12 has a corresponding number of thickened portions 20 having first recesses 21 on its upstream side, while the gas inlet casing 1 has second recesses 22 corresponding to the latter. Each of the first recesses 21 arranged in the thickened portions 20 additionally has an inner gap 23 in the region of the pin 19 (FIG. 1).

During operation of the diesel engine, the hot exhaust gases therefrom pass via the gas inlet casing 1 or the flow duct 10 arranged therein to the turbine rotor 6 of the exhaust gas turbine. The nozzle ring 14 in this case has the task of passing the exhaust gases in an optimum manner to the rotor blades 7 of the turbine rotor 6. The turbine rotor 6 driven in this manner in turn provides the drive for the compressor which is connected thereto and is not shown. The air compressed in the compressor is used for turbocharging, i.e. increasing the power, of the diesel engine.

The nozzle ring 14, which is arranged directly in the flow duct 10, is exposed to the high exhaust-gas temperatures in this process. Since its guide vanes 13 are relatively thin and the overall nozzle ring 14 moreover has a significantly lower mass than the gas inlet casing 1, the gas outlet casing 2 and the covering ring 8, the nozzle ring 14 undergoes a significantly greater rise in temperature than the said components surrounding it.

The formation according to the invention of the radial and the axial expansion gaps 16, 15 allows the outer ring 11 of the nozzle ring 14 to expand freely both in the radial and in the axial direction in accordance with the actual operating conditions. In this process, the significantly greater radial expansion of the material in the region between the outer ring 11 and the gas outlet casing 2 compared to the possible axial expansion of outer ring 11 and gas inlet casing 1 is taken into account by means of the abovementioned ratio of the gap widths of about 4:1. In this manner, the thermal stresses formed between the covering ring 8, the gas inlet casing 1, the gas outlet casing 2 and the nozzle ring 14 can be compensated. The nozzle ring 14 is thus firstly braced diagonally between the covering ring 8 and the gas inlet casing 1 and secondly acts as a diaphragm between the components surrounding it. Due to the formation of the assembly gap 18, the sealing surface 17 always bears against the gas inlet casing 1. The sealing surface 17 prevents leakage of exhaust gases to the environment. When sheet metal is used as the material for the nozzle ring 14, the flexible design thereof is additionally supported.

If the gap width of the axial and that of the radial expansion gap 15, 16 corresponds to the maximum thermal expansion of outer ring 11 and gas inlet casing 1 and of outer ring 11 and gas outlet casing 2, respectively, then the outer ring 11 bears axially against the gas inlet casing 1 and radially against the gas outlet casing 2 under full load of the diesel engine. As a result, the expansion gaps 15, 16 are closed during operation of the exhaust gas turbine. It is thus impossible for any exhaust gas to penetrate into the cavity formed between the outer ring 11, the gas outlet casing 2 and the diffuser 8. In this manner, both interference with the exhaust gas flow and losses through the gap are avoided, which results in a higher efficiency.

Figure 3:
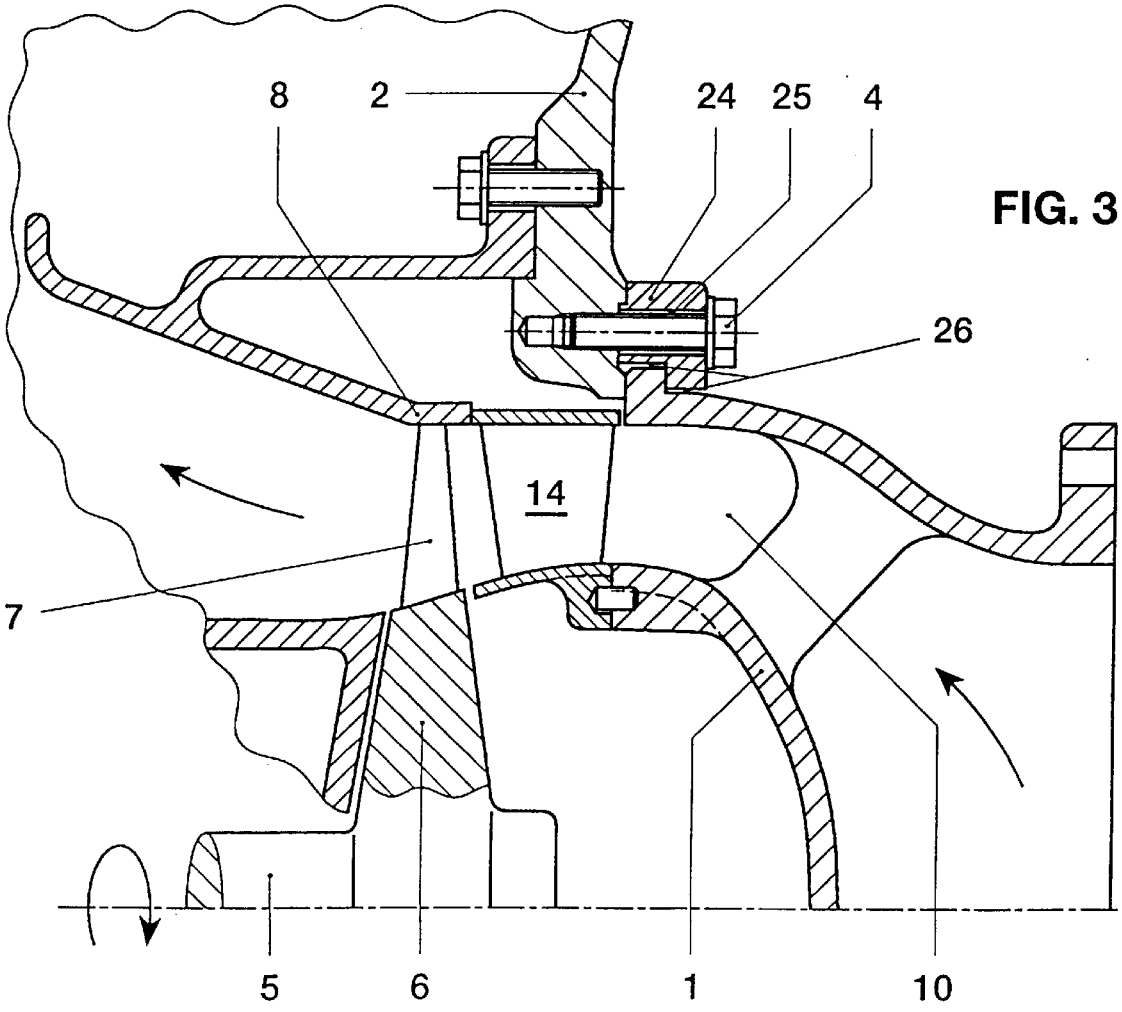
FIG. 3 shows an illustration corresponding to FIG. 1, but in a second exemplary embodiment.

In a second exemplary embodiment, a clamping segment 24, which is axially positively locking with the gas inlet casing 1 and also with the gas outlet casing 2, is arranged on the said gas inlet casing and is provided with recesses 25, designed as bores, for the screws 4. Radial gaps 26 are formed between the clamping segment 24 and the gas inlet casing 1 (FIG. 3) . As a result, the gas inlet casing 1 can also expand radially without increasing its operating stresses. The further arrangement and functioning of the components is similar to the first exemplary embodiment.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. An exhaust gas turbine of an exhaust gas turbocharger, comprising:

a) a gas inlet casing and a gas outlet casing, which are connected to form a turbine casing by connecting elements, b) a turbine rotor which is arranged in the turbine casing and is supported by a shaft, c) a covering ring, which is fastened in the gas outlet casing of the turbine rotor, d) a nozzle ring, which is arranged upstream of the turbine rotor, axially between the covering ring and the gas inlet casing and radially inside the gas outlet casing and comprises an outer ring, an inner ring and a plurality of guide vanes formed between the outer ring and inner ring, the inner ring being supported on the gas inlet casing by positioning elements to secure the nozzle ring against torsion, wherein e) the nozzle ring is diagonally supported by bearing against the covering ring with the outer ring and bearing against the gas inlet casing with the inner ring, and wherein f) an axial expansion gap is formed between the outer ring and the gas inlet casing and a radial expansion gap is formed between the outer ring and the gas outlet casing.

2. The exhaust gas turbine as claimed in claim 1, wherein a sealing surface with respect to the gas inlet casing is arranged on the gas outlet casing and an assembly gap is formed radially outside the sealing surface between gas inlet casing (1) and gas outlet casing.

3. The exhaust gas turbine as claimed in claim 1, wherein the gap width of the axial and/or of the radial expansion gap is designed to be larger than or equal to the maximum thermal expansion of outer ring and gas inlet casing and of outer ring and gas outlet casing, respectively.

4. The exhaust gas turbine as claimed in claim 3, wherein both the outer and also the inner ring each have a significantly smaller material thickness than the covering ring and the gas inlet casing.

5. The exhaust gas turbine as claimed in claim 4, wherein both the outer and also the inner ring are formed of sheet metal.

6. The exhaust gas turbine as claimed in claim 1, wherein a clamping segment, which is positively locking with the gas inlet casing and also with the gas outlet casing in the axial direction, is arranged on the said gas inlet casing and is provided with recesses for the connecting elements.

7. The exhaust gas turbine as claimed in claim 6, wherein at least one radial gap is formed between the gas inlet casing and the clamping segment.

* * * * *